United States Patent [19]

Yoshida

[11] Patent Number: 4,974,321

[45] Date of Patent: Dec. 4, 1990

[54] HAIR CUTTING DEVICE

[76] Inventor: Takaaki Yoshida, 20135 Sea Gull Way, Saratoga, Calif. 95070

[21] Appl. No.: 365,373

[22] Filed: Jun. 13, 1989

Related U.S. Application Data

[63] Continuation-in-part of Ser. No. 184,979, Apr. 22, 1988, abandoned.

[51] Int. Cl.[5] ..... B26B 19/44; B26B 19/20

[52] U.S. Cl. ..... 30/133; 30/201

[58] Field of Search ..... 30/133, 200, 201, 41.5

[56] References Cited

U.S. PATENT DOCUMENTS 4,628,601 12/1986 Van Slooten ..... 30/133

*Primary Examiner*—Douglas D. Watts

*Attorney, Agent, or Firm*—Don J. Flickinger; Jordan M. Meschkow

[57] ABSTRACT

A hair cutting guide for use with either a conventional pair of shears or hair clippers comprises a housing having first and second openings therein and a guide portion for receiving the conventional cutting apparatus in such a manner so as to define a cutting region within the housing. The housing is coupled to a source of vacuum at its output end, and its input end is coupled to at least one input member of a predetermined length. In this manner, hair is drawn into the input member under the force of the vacuum to the cutting region where it is clipped. The clipped hair is then drawn out of the housing by the vacuum to a collection area. The input members may vary in length and shape so as to achieve a desired hair style.

14 Claims, 3 Drawing Sheets

FIG. 1
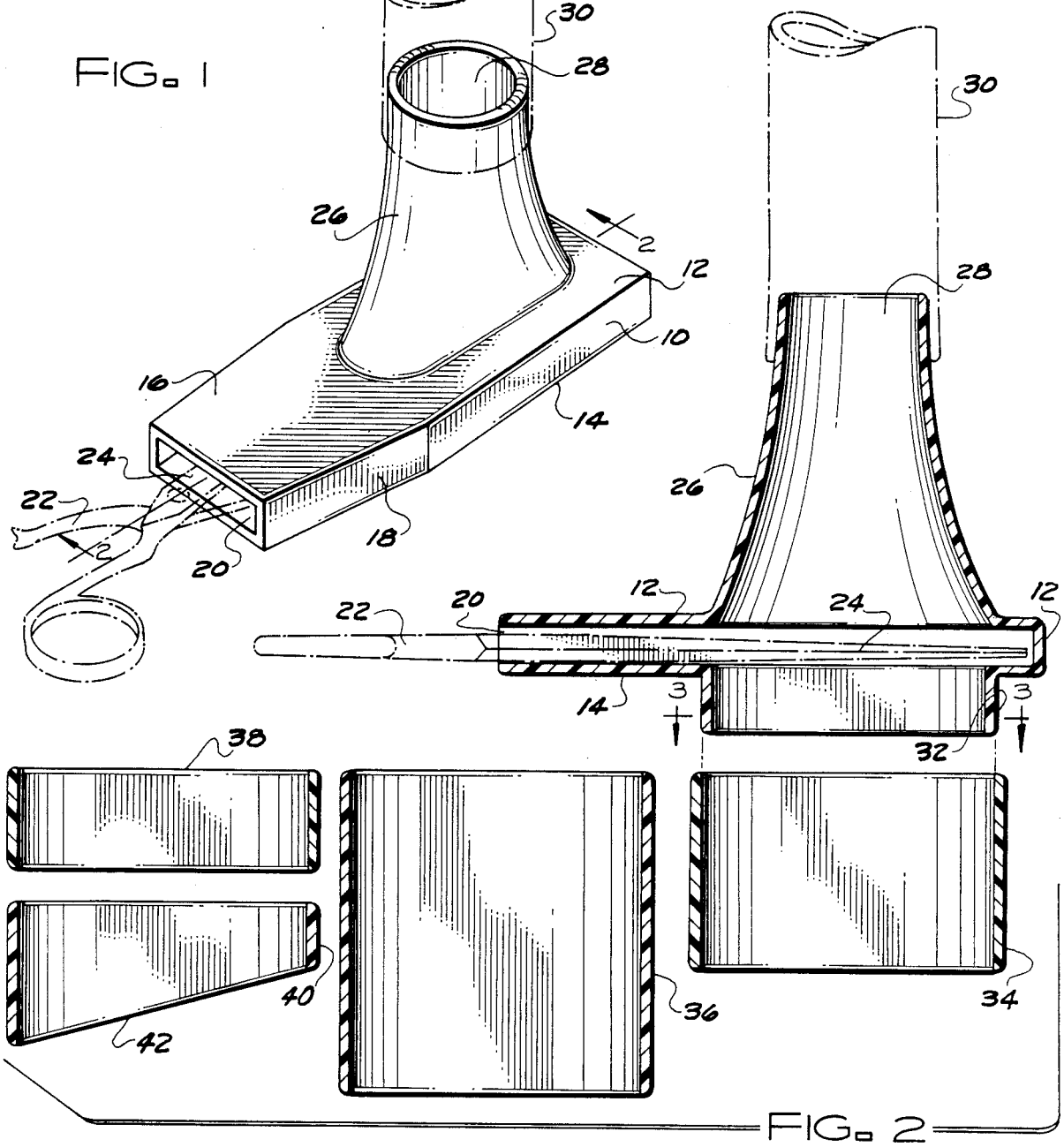
FIG. 2
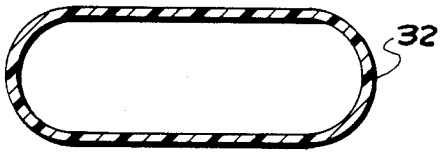
FIG. 3

FIG. 10
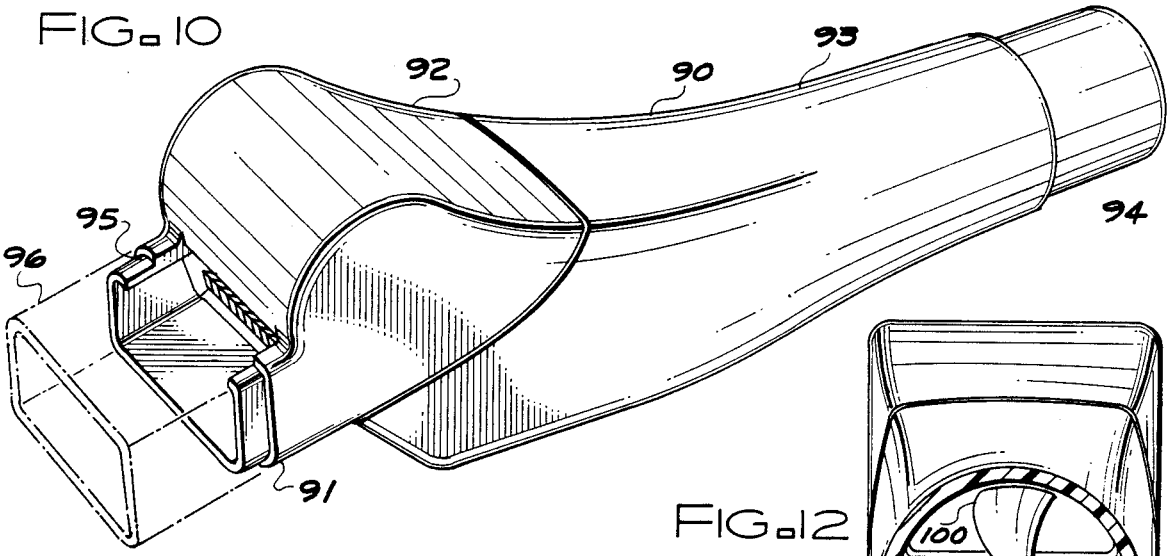
FIG. 12
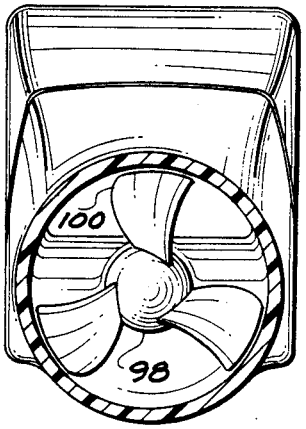
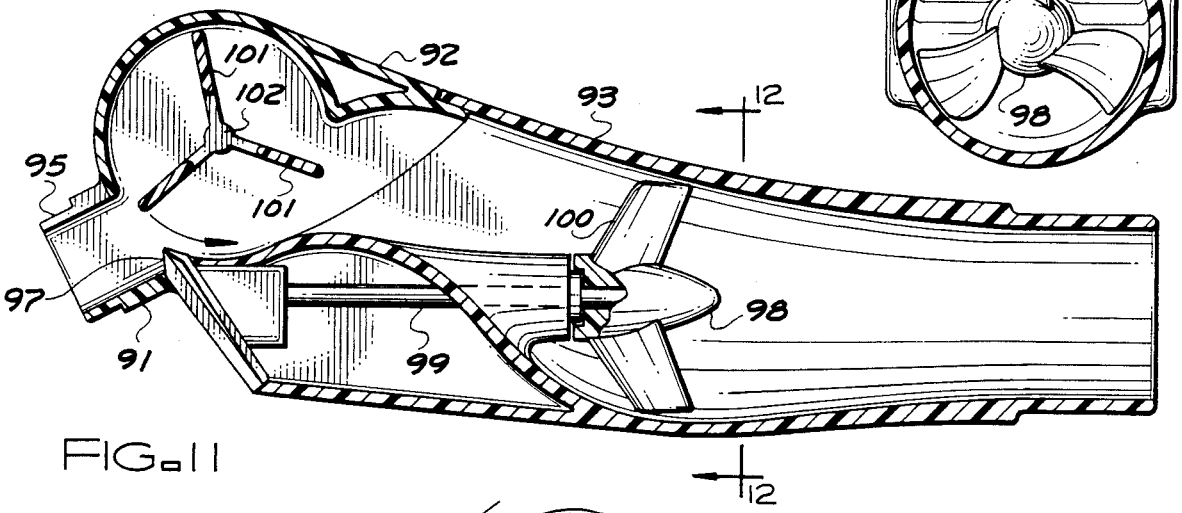
FIG. 11
FIG. 13
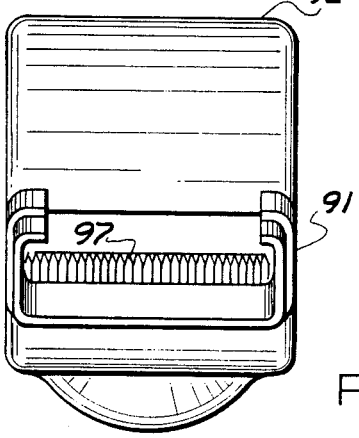
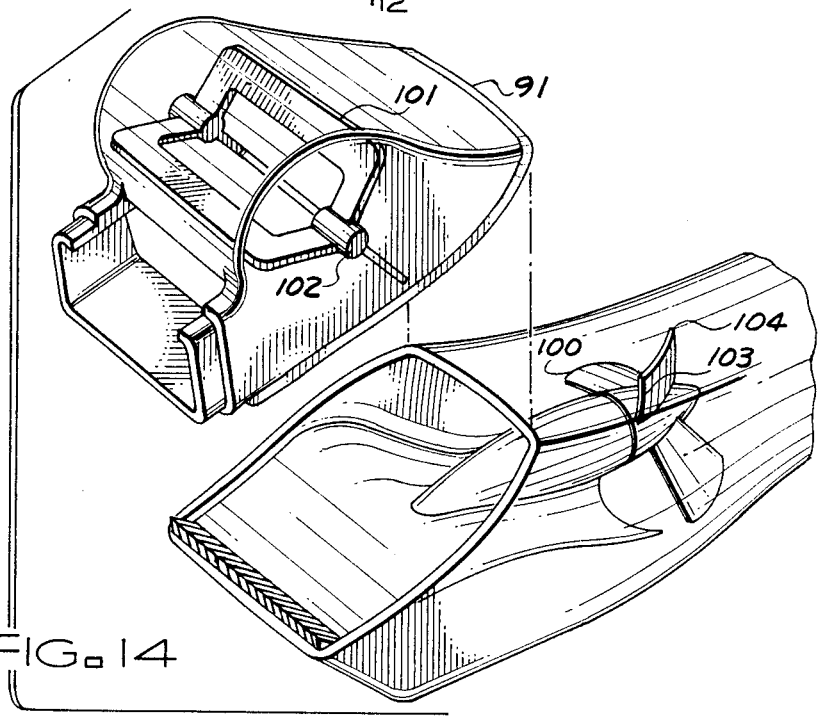
FIG. 14

HAIR CUTTING DEVICE

CROSS-REFERENCE TO RELATED APPLICATIONS

This application is a CONTINUATION IN PART of Application No. 184,979 filed on Apr. 22, 1988, now abandoned.

BACKGROUND OF THE INVENTION

1. Field of the Invention

This invention relates generally to hair cutting apparatus, and more particularly to a hair cutting guide which, when used in conjunction with a conventional pair of scissors, shears or an electric clipping device, assures uniformity while at the same time disposes of hair clippings.

2. The Prior Art

Hair grooming devices incorporating a vacuum have been known for many years, and the prior art is replete with examples thereof. Known, for example, are combing and brushing attachments for use in combination with a conventional vacuum cleaner hose. Similar apparatus have been devised for lifting and disposing of particulate matter. Also knownare devices which gauge or cut hair to a predetermined length. Additionally, the art has provided attachments for conventional electric razors. Such existing devices suffer, however, from one or more of the following disadvantages. In some cases, the devices are not structured to assure hair length uniformity nor do they provide for varying the desired hair length. In other cases, only a single cutting or clipping surface is presented making it difficult to use the device on different parts of the hair style; i.e. typically shorter hair is required around the ears than is required on the top of the head. In still other cases, no means are provided for automatically disposing of the hair clippings which must ultimately be disposed of. Finally, many known devices are not suitable for cutting the operator's own hair.

SUMMARY OF THE INVENTION

It is an object of the present invention to provide an improved hair cutting device.

It is a further object of the present invention to provide a hair cutting device which functions as a guide for cutting hair to a given length.

It is a still further object of the present invention to provide an improved hair cutting apparatus which disposes of all hair cuttings thereby eliminating cleanup.

A still further object of the present invention is to provide a hair cutting device which facilitates hair cutting of the operator's own hair.

Yet another object of the present invention is to provide a hair cutting apparatus which provides for varying the length to which hair is cut.

According to a broad aspect of the invention there is provided a hair cutting apparatus for use in conjunction with a pair of shears and a source of vacuum. The apparatus comprises a hollow housing having first and second openings therein and having a guide portion for receiving and guiding the cutting end of a pair of shears to a cutting plane within a cutting region of the housing. The first opening is coupled to a source of vacuum. At least one input member of a predetermined length is coupled to the second opening for guiding hair to be cut into the cutting region. The hair clippings are disposed of through the first opening.

According to a further aspect of the present invention there is provided a hair cutting apparatus for use in conjunction with a source of vacuum and a hair clipper having a cutting blade. The apparatus comprises a hollow housing having an input opening and an output opening, the output opening for coupling to the source of vacuum. First means are provided for detachably securing the shears to the housing such that the cutting blade resides in a cutting region proximate the input opening. At least one input member of a predetermined length is coupled to the input opening such that hair is drawn into the input member by the vacuum. Second means are provided for guiding the hair within the input member to the cutting region. Third means are provided to transfer some of the power from the second means in the device to the cutting blades.

According to a still further aspect of the present invention there is provided a hair cutting apparatus for use in conjunction with a source of vacuum and a hair clipper having a cutting blade. The output end is attached to a source of vacuum, and an input member of a predetermined length is attached to the input opening so that hair will be drawn through the input member to the cutting region. Power for the hair clipper is obtained from the flow of air beyond the cutting region. Cut hair is disposed of through the output opening.

BRIEF DESCRIPTION OF THE DRAWINGS

The above and other objects, features and advantages of the present invention will be more clearly understood from the following detailed description taken in conjunction with the drawings, in which:

FIG. 1 is a perspective view of a first embodiment of the inventive hair cutting apparatus;

FIG. 2 is a vertical sectional view of the inventive hair cutting apparatus taken along 2—2 in FIG. 1 and further including a plurality of input members;

FIG. 3 is a horizontal sectional taken along the line 3—3 in FIG. 2;

FIG. 10 is a perspective view of a third embodiment of the inventive hair cutting apparatus;

FIG. 11 is a vertical sectional view of the third embodiment of the inventive hair cutting apparatus, taken along the longitudinal axis thereof;

FIG. 12 is a vertical sectional view taken along line 12—12 of FIG. 11;

FIG. 13 is a front elevational view taken of the embodiment of FIG. 10; and FIG. 14 is an exploded perspective view illustrating the detachability of the hair guide means from the cutting blades.

DETAILED DESCRIPTION OF THE PREFERRED EMBODIMENT

Figure 4:
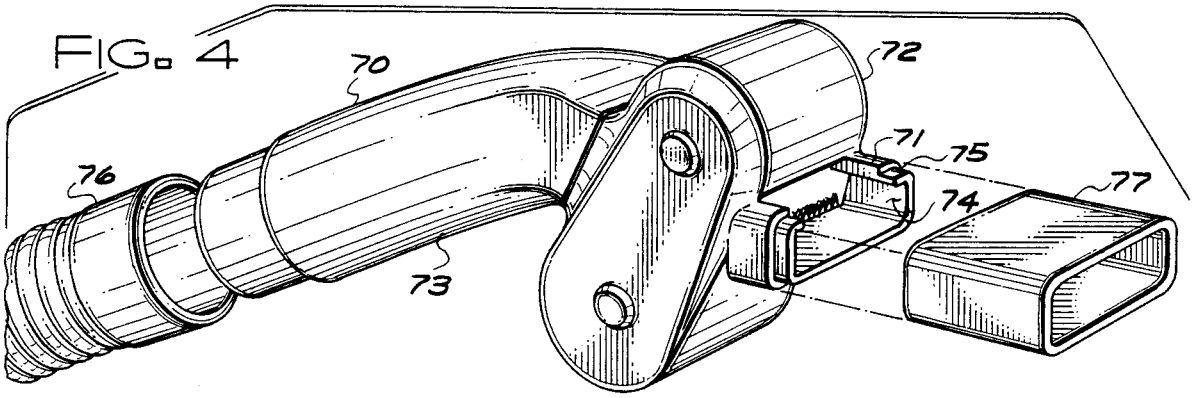
FIG. 4 is a perspective view of a second embodiment of the inventive hair cutting apparatus.

Turning now to the drawings in which like reference characters illustrate the same element throughout the severaal views, attention is first directed to FIGS. 1 and 2 which illustrate a first embodiment of the inventive hair cutting apparatus comprising a box-like housing 10 having an upper surface 12 and a lower surface 14 integral therewith. At one end of housing 10 is a tapered guide portion 16 having tapered sidewalls 18. As can be seen, the upper surface of guide portion 16 is contiguous with surface 12, and the lower surface of guide portion 16 is contiguous with surface 14. Guide portion 16 has an opening 20 therein for receiving the cutting end of a conventional pair of shears 22 shown in dotted lines. The height and width of the guide portion 16 is such that the shears can be manually opened and closed in the normal manner and yet not have a substantial amount of free-play in the vertical direction. Thus, guide portion 16 functions as a guide for blades 24 of shears 22.

A hollow coupling member 26 extends upward from surface 12 and has an opening 28 therein. Coupling member 26 may be coupled to a source of vacuum (not shown) as for example by means of a flexible hose 30 shown in dotted lines. Hollow attachment member 32 having a cross-section in the form of an oblate circle as shown in FIG. 3, extends downward from surface 14 of housing 10. A plurality of hollow input members 34, 36, 38 and 40 each of which are opened at both ends, are detachably securable with attachment member 32. That is, attachment member 32 is frictionally received within each of members 34, 36, 38 and 40. By utilizing input members of different lengths (input member 38 being of the shortest length, input member 36 of the greatest length, and input member 34 of an intermediate length) hair may be cut to different lengths. That is, the region in housing 12 between surfaces 12 and 14 forms a cutting region which includes a cutting plane corresponding to the plane in which blades 24 of shears 22 move. Hair will be cut to a length corresponding to the distance between the free end of input member (34, 36 or 38) and the cutting plane.

It should be appreciated that it may be desirable to taper the length of hair in certain regions. For this purpose, an input member 40 is provided having a tapered free end 42. The apparatus shown in FIGS. 1–3 may be used as follows. The device is hand held and the free end of the input member is placed against the head. As a result of the vacuum, hair is drawn upward through the input member and into the cutting region of housing 12. Blades 24 of shears 22 are opened and closed in the normal manner thereby trimming any hair which extends past the cutting plane. The trimmings are concurrently drawn off through opening 28 as a result of the vacuum.

Figure 5:
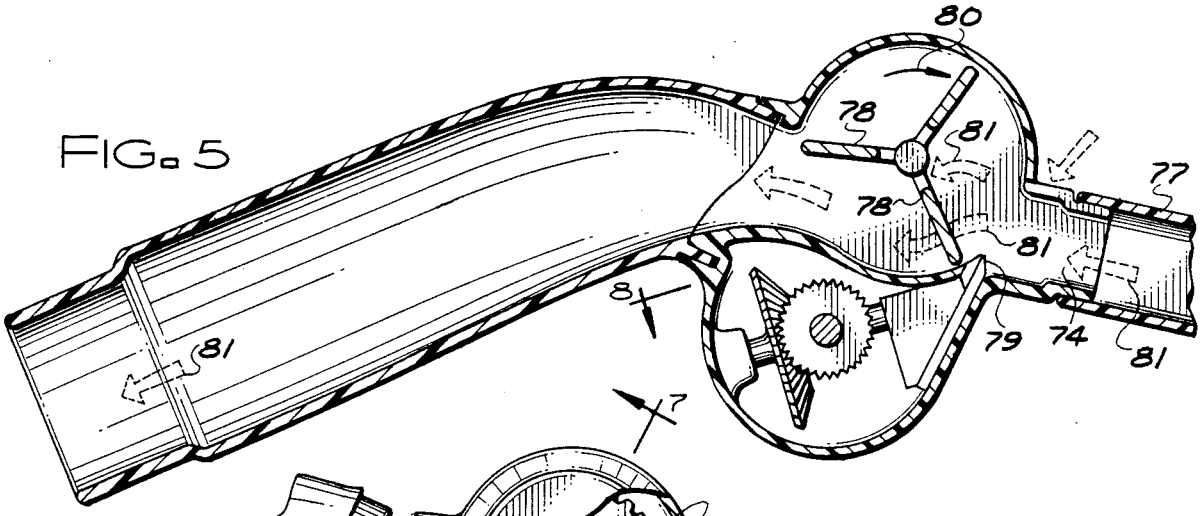
FIG. 5 is a vertical sectional view of the second embodiment of the inventive hair cutting apparatus, taken along the longitudinal axis thereof.
Figure 6:
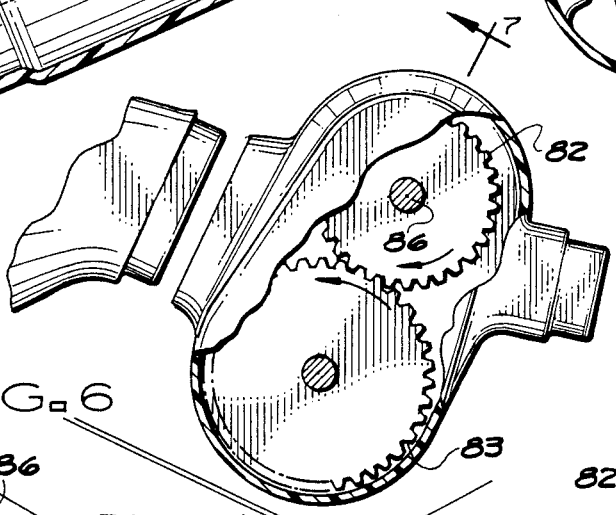
FIG. 6 is an enlarged fragmentary side view of the second embodiment of the inventive hair cutting apparatus partially broken away to show the gear means to provide power to the cutting apparatus.
Figure 9:
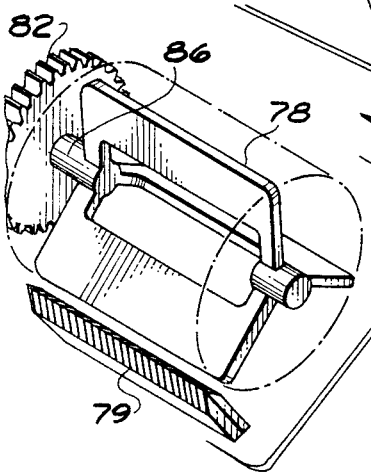
FIG. 9 is a fragmentary perspective view illustrating the relationship between the hair guide paddle wheel and the cutting blades.
Figure 8:
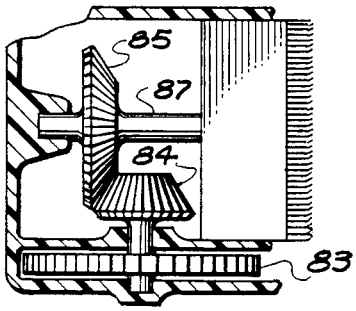
FIG. 8 is a sectional view taken along line 8—8 in FIG. 5.
Figure 7:
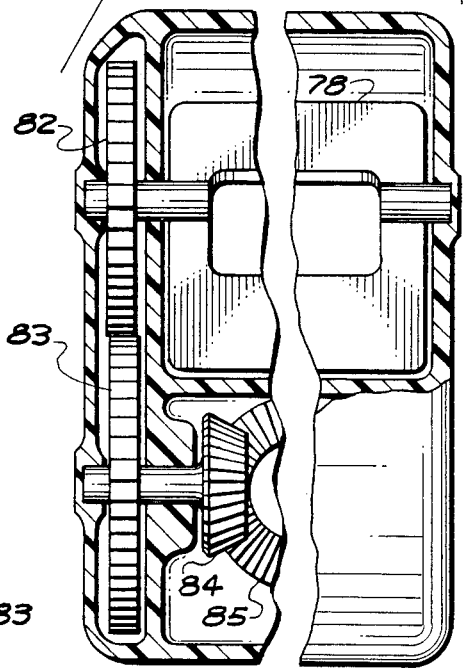
FIG. 7 is a vertical sectional view taken along line 7—7 in FIG. 6.

FIGS. 4 through 9 illustrate a second embodiment of the inventive hair cutting apparatus 70. The apparatus 70 includes hollow inlet means 71, cutter and hair rotor housing 72 and an outlet means 73. Outlet means 73 is connected to a vacuum cleaner hose 76. Hollow inlet means 71 has a lip 75 to allow an extension means 77. The length of extension means 77 will determine the length of the cut hair. By using a plurality of lengths for extension means 77, a user is able to set the length of the cut to a desired length. The apparatus requires a vacuum suction in order to operate. The vacuum suction is provided by hose 76 and the effects of that suction are illustrated by arrows 81. As air is drawn through inlet 74, paddle wheel blades 78 are forced to turn in a clockwise direction illustrated by arrow 80. As paddle wheel blades 78 are turned, so is gear 82 which is attached to the paddle wheel blades by means of shaft 86. Rotation of gear 82 induces rotation in gears 83, 84 and 85 respectively. Gear 85 provides power to cutting blades 79 through shaft 87. For optimum operation, paddle wheel blades 78 and cutting blades 79 should not be synchronized. This desynchronization can be established by making sure that the gear ratio between gears 82 and 83 is not 1:1. Cutting blades 79 are of the reciprocating type which are very well known in the art. Thus, an additional power source for the cutting blades is not required.

As hair is drawn through extension means 77 through inlet opening 74, paddle wheels 78 will force the hair into the cutters 79. The clipped hair is then drawn off under the force of the vacuum through outlet means 73 and into vacuum cleaner hose 76.

FIGS. 10 through 14 illustrate a third embodiment of inventive hair cutting apparatus 90. The apparatus 90 includes hollow inlet means 91, paddle wheel housing means 92, cutter and hair disposal housing 93 and an outlet means 94. Outlet means 94 is connected to a vacuum cleaner hose (not shown). Hollow inlet means 91 has a lip 95 to allow coupling to an extension means 96 (shown by dotted lines). The length of extension means 96 will determine the length of the cut hair. Paddle wheel blades 101 are mounted on shaft 102. In this embodiment of the apparatus, the paddle wheel blades 101 and shaft 102 rotate freely. Power for cutting blades 97 is provided by a propeller 98. Propeller 98 has a plurality of blades 100 mounted on it. As a vacuum suction draws air through the apparatus, the force of the air will turn propeller blades 100 and cause shaft 99 to rotate. Shaft 99 provides power to cutting blades 97. The front end 103 of propeller blade 100 is swept less than the back end 104. This provides less opportunity for the hair which is being pulled through housing 93 to get caught on propeller blades 100.

Referring now to FIG. 14. the paddle wheel housing means 92 can be disconnected from cutter and hair disposal housing 93. This allows the cutting blades 97 to be exposed. The apparatus can now be used for any purposes which require an exposed cutting blade such as trimming sideburns.

Thus, there has been shown and described a hair cutting device which solves all of the above-mentioned disadvantages. That is, the apparatus serves as a guide for cutting hair to a desired length including a desired taper. The inventive apparatus assures that all cuttings are retained and gathered at a collection point thus eliminating undesirable clean up. Finally the device can be easily used to cut the operator's own hair.

The above description is given by way of example only. Changes in form and details may be made by one skilled in the art without departing from the scope of the invention as defined by the appended claims.

I claim:

1. A hair cutting apparatus for use in conjunction with a source of vacuum, said apparatus comprising:

a housing means having an input opening and an output opening, said output opening for coupling to said source of vacuum;

cutting means for cutting hair within said housing means;

power conversion means for converting air velocity within said housing means to power for said cutting means; at least one input member of a predetermined length coupled to said input opening such that hair is drawn into said input opening by said vacuum; and a paddle wheel positioned within said housing proximate said input opening and said cutting region, said paddle wheel for turning under the force of said vacuum and for guiding hair entering said input opening to said cutting means.

2. An apparatus according to claim 1 wherein said power conversion means comprises power transfer means to transfer rotational power of said paddle wheel to said cutting means.

3. An apparatus according to claim 1, wherein said housing includes a generally transverse cylindrical portion for housing said paddle wheel.

4. An apparatus according to claim 1, wherein said predetermined length corresponds to that which is necessary to achieve a desired hair length.

5. An apparatus according to claim 4, wherein said at least one input member has an output end coupled to said input opening and has an input end through which hair to be cut enters.

6. An apparatus according to claim 5, wherein the plane of said input end is substantially parallel to the plane of said output end.

7. An apparatus according to claim 5, wherein said at least one input member is detachably securable to said input opening.

8. An apparatus according to claim 1, wherein said power conversion means functions independently of said paddle wheel.

9. A hair cutting apparatus for use in conjunction with a source of vacuum, said apparatus comprising:

a first housing means having an input opening and an output opening, said output opening connected to a source of vacuum causing hair to be drawn through said input opening;

a second housing means, said second housing means having an input opening, and an output opening, said input opening of said second housing means being conducted to said output opening of said first housing means; cutting means for cutting hair located within said second housing means;

paddle wheel means within said first housing means for guiding hair to said cutting means; and power conversion means within said second housing means for converting air velocity within said second housing means to power for said cutting means.

10. The hair cutting apparatus of claim 9, wherein said first housing means and said second housing means are detachably connected.

11. A hair cutting apparatus for use in conjunction with a source of vacuum, said apparatus comprising:

a housing means having an input opening and an output opening, said output opening for coupling to said source of vacuum;

cutting means for cutting hair within said housing means;

at least one input member of a predetermined length coupled to said input opening such that hair is drawn into said input opening by said vacuum;

guide means, mounted in said input member and movable in response to the flow of air through said housing, for guiding hair in said input member to said cutting means; and power conversion means, independent of said guide means, for converting air velocity within said housing means to power for said cutting means.

12. A hair cutting apparatus for use in conjunction with a source of vacuum, said apparatus comprising:

a housing means having an input opening and an output opening, and defining a longitudinally extending flow path, said output opening for coupling to said source of vacuum;

cutting means for cutting hair within said housing means;

power conversion means for converting air velocity within said housing means to power for said cutting means, said power conversion means including a propeller having a central hub mounted for rotation about a longitudinal axis substantially parallel to said flow path, and a plurality of blades of predetermined height extending radially from said central hub, and shaft means extending longitudinally from and rotatable with said hub, said shaft means having one end coupled to said cutting means for transferring rotational power thereto;

at least one input member of a predetermined length coupled to said input opening such that hair is drawn into said input opening by said vacuum; and guide means for guiding hair in said input member to said cutting region.

13. A hair cutting apparatus according to claim 12, wherein the clearance between each of said blades and said housing is negligible in relation to the height of said blades.

14. The hair cutting device of claim 12, wherein said power conversion device comprises a full admission axial flow turbine.

* * * * *